US012203198B2

(12) United States Patent
Boylan et al.

(10) Patent No.: US 12,203,198 B2
(45) Date of Patent: Jan. 21, 2025

(54) PRODUCTION OF FIBER WEBS USING AIRLAID NONWOVENS

(71) Applicant: WACKER CHEMIE AG, Munich (DE)

(72) Inventors: John Richard Boylan, Bethlehem, PA (US); Conrad William Perry, Trexlertown, PA (US); John Richards, Sylvania, OH (US)

(73) Assignee: Wacker Chemie AG, Munich (DE)

( * ) Notice: Subject to any disclaimer, the term of this patent is extended or adjusted under 35 U.S.C. 154(b) by 175 days.

(21) Appl. No.: 17/786,182

(22) PCT Filed: Dec. 17, 2019

(86) PCT No.: PCT/US2019/066917

§ 371 (c)(1),
(2) Date: Jun. 16, 2022

(87) PCT Pub. No.: WO2021/126171

PCT Pub. Date: Jun. 24, 2021

(65) Prior Publication Data

US 2023/0027845 A1 Jan. 26, 2023

(51) Int. Cl.

| | |
|---|---|
| ***D04H 1/587*** | (2012.01) |
| ***D04H 1/425*** | (2012.01) |
| ***D04H 1/541*** | (2012.01) |
| ***D04H 1/64*** | (2012.01) |
| ***D04H 1/732*** | (2012.01) |
| ***D06M 15/263*** | (2006.01) |
| ***D06M 15/643*** | (2006.01) |
| *D06M 101/06* | (2006.01) |
| *D06M 101/20* | (2006.01) |
| *D06M 101/32* | (2006.01) |

(52) U.S. Cl.

CPC ..... *D04H 1/587* (2013.01); *D04H 1/425* (2013.01); *D04H 1/5412* (2020.05); *D04H 1/64* (2013.01); *D04H 1/732* (2013.01); *D06M 15/263* (2013.01); *D06M 15/643* (2013.01); *D06M 2101/06* (2013.01); *D06M 2101/20* (2013.01); *D06M 2101/32* (2013.01)

(58) Field of Classification Search

CPC ..... D04H 1/587; D04H 1/64; D06M 15/263; D06M 15/643; D06M 2101/06; D06M 2101/20; D06M 2101/32

See application file for complete search history.

(56) References Cited

U.S. PATENT DOCUMENTS

| | | | | |
|---|---|---|---|---|
| 3,402,070 | A | 9/1968 | Brodmann | |
| 4,950,545 | A | 8/1990 | Walter et al. | |
| 4,959,249 | A * | 9/1990 | Schilling | D06M 15/227 442/128 |
| 4,973,513 | A * | 11/1990 | Riedel | C09J 7/201 427/407.1 |
| 5,814,188 | A | 9/1998 | Vinson et al. | |
| 6,861,380 | B2 | 3/2005 | Garnier et al. | |
| 9,938,647 | B2 | 4/2018 | Bauers | |
| 2007/0044930 | A1 | 3/2007 | Vinson et al. | |
| 2010/0269283 | A1 | 10/2010 | Shim et al. | |
| 2014/0066872 | A1 | 3/2014 | Baer et al. | |

FOREIGN PATENT DOCUMENTS

| | | | |
|---|---|---|---|
| EP | 1375542 | A1 | 1/2004 |
| WO | 1993015245 | A1 | 8/1993 |
| WO | WO9315245 | * | 8/1993 |
| WO | 1996039553 | A1 | 12/1996 |
| WO | 2011053946 | A1 | 5/2011 |

OTHER PUBLICATIONS

Fox T.G., Influence of Diluent and of Copolymer Composition on the Glass Temperature of a Polymer System, Bull. Am. Physics Soc. 1, 3, p. 123 (1956).

* cited by examiner

*Primary Examiner* — Nathan T Leong

(74) *Attorney, Agent, or Firm* — BROOKS KUSHMAN P.C.

(57) ABSTRACT

Nonwoven fiber webs are produced by spraying one or more aqueous binder formulations containing one or more polymers selected from the group of vinyl ester polymers and (meth)acrylic ester polymers, and in a separate step, spraying one or more aqueous silicone formulations containing one or more polysiloxanes, onto the surface of an airlaid nonwoven.

16 Claims, No Drawings

PRODUCTION OF FIBER WEBS USING AIRLAID NONWOVENS

CROSS-REFERENCE TO RELATED APPLICATION

This application is the U.S. national phase of PCT Application No. PCT/US2019/066917 filed on Dec. 17, 2019, the disclosure of which is incorporated in its entirety by reference herein.

BACKGROUND OF THE INVENTION

1. Field of the Invention

This invention relates to a process for producing fiber webs using airlaid nonwovens, to fiber webs obtained by such a process as well as to their use, for example, as clean room wipes or medical draping for instance.

2. Description of the Related Art

The production of fiber webs by the airlaid process is known per se and may be performed by blowing fibers, for example cellulose fibers (fluff pulp), with air onto a wire screen, followed by aspirating the air and consolidating the sheet like fibrous structure. The consolidating of the sheet like fibrous structure can be carried out in different ways, for example by latex chemical bonding, thermal bonding, pressure bonding or spun bonding. An airlaid process with latex chemical bonding is described in WO-A 96/39553, for instance.

Despite these bonding methods, not all fibers are securely bonded into the substrate and can become loose and create lint during handling in subsequent process steps or by end-users. Such linting can lead to defective products and is even more fatal if lint contaminates critical applications, for instance in applications as clean room wipes or in medical applications where loose fibers could enter an open wound or otherwise contaminate human tissue. It is therefore desirable to reduce the presence and amount of loose fibers.

Besides airlaid nonwovens also wet laid nonwovens or tissue like substrates are known. Wetlaid nonwovens are produced by suspending fibers in water and laying down them by a water jet forming a nonwoven. Wetlaid nonwovens as well as tissue like substrates are more compact and more densified than airlaid nonwovens and, therefore, structurally totally different than airlaid nonwovens. The fibres in wet laid products or tissue like substrates are more strongly bonded to each other, for instance by hydrogen bridge bonds or fiber entanglement, compared to airlaid products. The linting issue is much more serious with airlaid nonwovens than with wetlaid nonwovens or tissue like substrates, particularly in case of short fibers. Therefore, prior art dealing with the linting of wet laid nonwovens or tissue like substrates seems not helpful in solving the linting of airlaid nonwovens.

U.S. Pat. No. 4,950,545 aims at soft, multifunctional facial tissue manufactured by wet lay process for eye glass cleaning and nose care and teaches for that purpose the modification of the tissue with silicone. U.S. Pat. No. 4,950,545 is indifferent to the type and point of silicone addition but is focused on printing the silicone with rotogravure printer onto the tissue. Also U.S. Pat. No. 5,814,188 desires soft tissue paper without impairing its strength and teaches depositing softening agents on the surface of wet laid tissues. Examples of softening agents are quaternary ammonium compounds and polydimethyl siloxanes, applied onto wet laid tissue by means of a printing roll, such as a gravure patterned roll. U.S. Pat. No. 6,861,380 deals with tissue products based on a multi-layered paper web and teaches the application of a layer formed from pulp fibers and synthetic fibers to reduce lint and slough. The paper web is a wet laid tissue product.

US2007/0044930 deals with the softening of fibrous structures, such as sanitary tissue products, for providing a soft feel to the consumer's skin and requires for that purpose a non-silicone oil system comprising mineral oils or natural and vegetable oils as a bulk softening agent which migrates throughout the fibrous structure. Additionally, a couple of optional ingredients might be applied such as antiviral agents or surface softening agents, the latter of which are for providing a lubricious feel and can be selected from a vast list comprising chemicals from various categories, such as waxes, quaternary ammonium softeners, emollients like fatty acid esters, alkyl ethoxylates or polyhydroxy fatty acid amides, or silicones. The fibrous structures might be prepared by any kind of process like felt-pressing, pattern densifying, wet laying or air laying methods. In detail, US2007/0044930 discloses the preparation of paper by wet laying of fibers using a bulk softening agent and a silicone solution as surface softening agent. Polymer bonded fibers are not described in the examples of US2007/0044930. US2007/0044930 recognized the issue of lint formation and teaches, for avoiding such problems, the application of additional ingredients as lint resisting agents without giving examples for such agents.

US2010/0269283 describes the manufacturing of polyolefin meltblown, spunbond or spunlaced nonwoven substrate that is subjected to needling, perforation, embossing and finally corona treatments. The linting is reduced by pressing the nonwoven fabric with an embossing line. Chemically bonded airlaids are not mentioned.

Against this background, the object was to provide fiber webs based on airlaid nonwovens which have no or at least reduced fiber lint, particularly no or reduced short fiber lint, particularly for application as clean room wipes or medical draping.

SUMMARY OF THE INVENTION

The invention provides a process for producing fiber webs, wherein one or more aqueous binder formulations containing one or more polymers selected from the group comprising vinyl esters polymers and (meth)acrylic esters polymers and, in a separate step, one or more aqueous silicone formulations containing one or more polysiloxanes are sprayed onto the surface of an airlaid nonwoven. The invention further provides fiber webs obtained by the process according to the invention.

DETAILED DESCRIPTION OF THE PREFERRED EMBODIMENTS

Preferred polysiloxanes are composed of units of the general formula $$R_cSi(OR')_d(OH)_eO_{(4-c-d-e)/2}$$

with c=0 to 3, d=0 to 3, e=0 to 3, and with the sum c+d+e being per unit not more than 3.5, in which in each case R is identical or different and denotes branched or unbranched alkyl radicals having 1 to 22 C atoms, cycloalkyl radicals having 3 to 10 C atoms, alkylene radicals having 2 to 4 C atoms, and also aryl, aralkyl, and alkylaryl radicals having 6 to 18 C atoms, and R' denotes identical or different alkyl radicals and alkoxyalkylene radicals having in each case 1 to 4 C atoms, preferably methyl and ethyl, where the radicals R and R' may also be substituted by halogens such as chlorine, by ether, thioether, ester, amide, nitrile, hydroxyl, amine, carboxyl, sulfonic acid, carboxylic anhydride, and/or carbonyl groups.

Particularly preferred polysiloxanes conform to the general formula $R'''_aR''_{3-a}SiO(SiR''_2O)_nSiR''_{3-a}R'''_a$, in which the individual radicals R" independently of one another may adopt the definitions indicated earlier on above for R and (OR'), and R''' is OH, a denotes an integral value between 0 and 3, and n adopts an integral value between 0 and 500.

Preferred radicals R" are methyl, ethyl, n-propyl, isopropyl, 1-n-butyl, 2-n-butyl, isobutyl, tert-butyl, n-pentyl, isopentyl, neopentyl, tert-pentyl, hexyl, heptyl, octyl, nonyl, decyl, dodecyl or octadecyl radicals, cycloalkyl radicals such as cyclopentyl, cyclohexyl, cycloheptyl, and methylcyclohexyl radicals. With particular preference the radicals R" are monovalent hydrocarbon radicals having 1 to 6 carbon atoms, such as methyl, ethyl, n-propyl, isopropyl, n-butyl, sec-butyl, amyl, and hexyl radicals, with the methyl radical being the most preferred.

Preferred alkoxy radicals R" are those having 1 to 6 carbon atoms such as methoxy, ethoxy, propoxy, and n-butoxy radical, which optionally may also be substituted by oxyalkylene radicals such as oxyethylene or oxymethylene radicals or poly(oxyalkylene) radicals such as polyoxyethylene or polyoxypropylene radicals. Particularly preferred are the methoxy radical and ethoxy radical.

The stated alkyl radicals and alkoxy radicals R" may optionally also be substituted by halogen, mercapto groups, epoxy-functional groups, carboxyl groups, keto groups, enamine groups, isocyanato groups, aryloxy groups, alkoxysilyl groups, hydroxyl groups or preferably amino groups or aminoethylamino groups.

a stands preferably for the integral values 1 or 2 and more preferably for 1.

n stands preferably for integral values between 0 and 200, even more preferably for integral values between 1 and 100, with particular preference for integral values between 1 and 50, even more preferably for integral values between 1 and 25, and most preferably for integral values between 1 and 15.

Most preferred polysiloxanes are dimethylpolysiloxanes, more particularly dimethylpolysiloxanes having Si—OH groups in the terminal units, which may be functionalized by amino-groups, amino-alkyl-groups or polyether groups. Also preferred are mixtures of linear or branched functionalized or unfunctionallized dimethylpolysiloxanes. The polysiloxanes preferably do not carry any ethylenically unsaturated group.

The polysiloxanes are preferably emulsifier stabilized. Common emulsifiers might be applied in common portions.

The dynamic viscosity of the polysiloxanes is preferably 0.1 to 500 mPas, more preferably 0.5 to 360 mPas, very preferably 1 to 100 mPas, even more preferably 1 to 50 mPas, and most preferably 2 to 25 mPas (determined in accordance with ISO3104 at 25° C.)

The surface tension of the polysiloxanes is preferably 15 to 45 mPas, more preferably 15 to 22 mPas, very preferably 16 to mPas, even more preferably 16 to 20 mPas, and most preferably 16 to 19 mPas (determined in accordance with DIN53914 at 25° C.)

The aqueous silicone formulations contain preferably 0.1 to 5.0 wt %, more preferably 0.3 to 3.0 wt % and most preferably 0.5 to 2.0 wt % of polysiloxanes (solid), based on the dry weight of the aqueous silicone formulations.

The aqueous silicone formulations may contain one or more wetting agents, particularly anionic wetting agents.

Examples of anionic wetting agents are alkyl sulfates having a chain length of 8 to 18 carbon atoms, alkyl or alkylaryl ether sulfates having 8 to 18 carbon atoms in the hydrophobic moiety and up to 40 ethylene or propylene oxide units, alkyl or alkylaryl sulfonates having 8 to 18 carbon atoms, oleic acid sulfonates, esters and monoesters of sulfosuccinic acid with monohydric alcohols or alkylphenols.

Suitable nonionic wetting agents are for example alkyl polyglycol ethers or alkylaryl polyglycol ethers having 8 to 40 ethylene oxide units, polymers of ethylene oxide (EO), polymers of propylene oxide (PO) or EO-PO copolymers.

Preference is given to esters of the anionic sulfosuccinic esters. Examples are dioctyl sulfosuccinate salts or diethylhexyl sulfosuccinate salts, also known under the trade names Aerosol® OT or Empimin® OT; or didecyl sulfosuccinate sodium salts, also known under the trade names Geropon® DDS65 or Empimin® ID65; or diisotridecyl sulfosuccinate sodium salts, also known under the trade names Geropon® Bis/Sodico or Empimin® TR70 or Aerosol® TR70; or monoesters of the sulfosuccinic esters. Preferred are alkali salts, particularly sodium salts.

The aqueous silicone formulations contain preferably 0.1 to 5.0 wt %, more preferably 0.3 to 3.0 wt % and most preferably 0.5 to 2.0 wt % of wetting agents, based on the dry weight of the aqueous silicone formulations.

The aqueous silicone formulations may contain one or more additives, such as superabsorbents (SAPs), fillers such as silica gel, flame retardants, expandable microbeads, activated carbon or softeners. The aqueous silicone formulations contain preferably 0 to 20 wt %, more preferably 0.1 to 10 wt % and most preferably 0.5 to 5 wt % of additives, based on the dry weight of the aqueous silicone formulations. In an alternative embodiment, the aqueous silicone formulations do not contain additives.

The aqueous silicone formulations contain water and optionally one or more solvents, such as alcohols, ethers or esters.

The aqueous silicone formulations have solids of preferably 0.1% to 5%, more preferably 0.3% to 3.0% and most preferably 0.5% to 2.0%.

The aqueous silicone formulations may be obtained by mixing their individual constituents, preferably at room temperature with common stirrers. The polysiloxanes are preferably applied in the form of aqueous emulsions. Such polysiloxanes are commercially available.

Suitable polymers are selected from the group comprising vinyl esters polymers and (meth)acrylic esters polymers.

Preference is given to vinyl esters polymers based on one or more vinyl esters of carboxylic acids having 2 to 15 carbon atoms, such as vinyl acetate, vinyl propionate, vinyl butyrate, vinyl 2-ethylhexanoate, vinyl laurate, 1-methylvinyl acetate, vinyl pivalate and vinyl esters of α-branched monocarboxylic acids having 9 to 11 carbon atoms, for example VeoVa9R or VeoVa10R (trade name of Hexion). Particular preference is given to vinyl acetate.

Preference is also given to (meth)acrylic esters polymers based on one or more esters of acrylic acid or methacrylic acid are, for example, esters of unbranched or branched alcohols having 1 to 15 carbon atoms, such as methyl acrylate, methyl methacrylate, ethyl acrylate, ethyl methacrylate, propyl acrylate, propyl methacrylate, n-butyl acrylate, n-butyl methacrylate, 2-ethylhexyl acrylate, norbornyl acrylate. Preference is given to methyl acrylate, methyl methacrylate, n-butyl acrylate and 2-ethylhexyl acrylate.

The polymers preferably contain one or more crosslinking monomer units. Examples for crosslinking monomer are precrosslinking monomers such as polyethylenically unsaturated comonomers, for example divinyl adipate, diallyl maleate, allyl methacrylate or triallyl cyanurate. Preferred are postcrosslinking monomers, for example acrylamidoglycolic acid (AGA), methacrylamidoglycolate (MAGME), N-methylolacrylamide (NMA), N-methylolmethacrylamide (NMMA), N-methylolallyl carbamate, alkyl ethers such as the isobutoxy ether or esters of N-methylolacrylamide, of N-methylolmethacrylamide and of N-methylolallyl carbamate. Also suitable are epoxy-functional comonomers such as glycidyl methacrylate and glycidyl acrylate. Further examples are silicon-functional comonomers, such as acryloyloxypropyltri(alkoxy)- and methacryloyloxypropyltri(alkoxy)silanes, vinyltrialkoxysilanes and vinylmethyldialkoxysilanes, where the alkoxy groups present may, for example, be methoxy, ethoxy and ethoxy propylene glycol ether radicals.

Preferred crosslinking monomers are postcrosslinking monomers, particularly methylol-units containing crosslinking monomers, more preferred N-methylolacrylamide (NMA). Most preferred is NMA-LF which is a mixture comprising N-methylolacrylamide and acrylamide, preferably a 50/50 molar ratio, also referred to a MAMD.

The polymers may contain one or more further ethylenically unsaturated monomer units, preferably selected from the group comprising vinylaromatics, such as styrene, methylstyrene or vinyltoluene, olefins, such as ethylene or propylene, 1,3-dienes, such as 1,3-butadiene or isoprene, and vinyl halides, such as vinyl chloride. Preferred further ethylenically unsaturated monomers are olefins, particularly ethylene.

The polymers may be based additionally on one or more auxiliary monomers, preferably on 0 to 10 wt %, more preferably 0.5 to 5 wt %, based on the total weight of the polymers. Examples of auxiliary monomers are ethylenically unsaturated mono- and dicarboxylic acids, preferably acrylic acid, methacrylic acid, fumaric acid and maleic acid; ethylenically unsaturated carboxamides and carbonitriles, preferably acrylamide and acrylonitrile; mono- and diesters of fumaric and maleic acid such as the diethyl and diisopropyl esters, and also maleic anhydride, ethylenically unsaturated sulfonic acids and/or salts, preferably vinylsulfonic acid, 2-acrylamido-2-methylpropanesulfonic acid. Also suitable are monomers having hydroxyl or carboxyl groups, examples being hydroxyalkyl esters of methacrylic acid and of acrylic acid such as hydroxyethyl acrylate, hydroxyethyl methacrylate, hydroxypropyl acrylate, hydroxypropyl methacrylate, hydroxybutyl acrylate or hydroxybutyl methacrylate, and also 1,3-dicarbonyl compounds such as acetoacetoxyethyl acrylate, acetoacetoxypropyl methacrylate, acetoacetoxyethyl methacrylate, acetoacetoxybutyl methacrylate, 2,3-di(acetoacetoxy)propyl methacrylate and allyl acetoacetate.

Preference is given to homopolymers of vinyl acetate; copolymers with vinyl acetate and ethylene; copolymers with vinyl acetate, ethylene and one or more crosslinking monomer, particularly postcrosslinking monomers; copolymers with vinyl acetate, ethylene and a vinyl ester of α-branched monocarboxylic acids having 9 to 13 carbon atoms; copolymers with vinyl acetate and one or more (meth)acrylic esters of branched or unbranched alcohols having 1 to 18 carbon atoms, especially methyl acrylate, ethyl acrylate, propyl acrylate, n-butyl acrylate, 2-ethylhexyl acrylate, 2-propylheptyl acrylate and optionally ethylene; copolymers with one or more vinyl esters, ethylene and one or more vinyl halides and also optionally further vinyl esters and/or (meth)acrylic esters; copolymers with one or more (meth)acrylic esters of branched or unbranched alcohols having 1 to 18 carbon atoms, such as n-butyl acrylate and 2-ethylhexyl acrylate and/or methyl methacrylate; wherein the recited mixtures may optionally also contain one or more of the abovementioned auxiliary monomers.

Particular preference is given to copolymers of one or more vinyl esters with 1 to 50 wt % of ethylene; copolymers of one or more vinyl esters with 1 to 50 wt % of ethylene and 0.5 to 10.0 wt % of postcrosslinking monomers; copolymers of vinyl acetate with 1 to 50 wt % of ethylene and 1 to 50 wt % of one or more further comonomers from the group vinyl esters having 1 to 13 carbon atoms in the carboxylic acid moiety such as vinyl propionate, vinyl laurate, vinyl esters of alpha-branched carboxylic acids having 9 to 13 carbon atoms such as VeoVa9, VeoVa10, VeoVa11 and optionally 0.5 to 10.0 wt % of postcrosslinking monomers; copolymers of one or more vinyl esters, 1 to 50 wt % of ethylene and preferably 1 to 60 wt % of (meth)acrylic ester of branched or unbranched alcohols having 1 to 15 carbon atoms, especially n-butyl acrylate, 2-propylheptyl acrylate or 2-ethylhexyl acrylate and optionally 0.5 to 10.0 wt % of postcrosslinking monomers; and copolymers with 30 to 75 wt % of vinyl acetate, 1 to 30 wt % of vinyl laurate or vinyl ester of an alpha-branched carboxylic acid having 9 to 13 carbon atoms, and also 1 to 30 wt % of (meth)acrylic ester of branched or unbranched alcohols having 1 to 17 carbon atoms, especially n-butyl acrylate, 2-propylheptyl acrylate or 2-ethylhexyl acrylate, which additionally contain to 40 wt % of ethylene and optionally 0.5 to 10.0 wt % of postcrosslinking monomers; copolymers with one or more vinyl esters, 1 to 50 wt % of ethylene and 1 to 60 wt % of vinyl chloride and also optionally further vinyl esters and/or (meth)acrylic esters and optionally 0.5 to 10.0 wt % of post-crosslinking monomers; wherein the polymers may additionally contain the recited auxiliary monomers in the recited amounts, and the recitations in wt % add up to 100 wt % in each case.

Most preference is given to copolymers with vinyl acetate and to 50 wt %, especially 5 to 25 wt % of ethylene; or copolymers with vinyl acetate and 5 to 50 wt %, especially 5 to 25 wt % of ethylene and 1.0 to 6.0 wt % of postcrosslinking monomers, particularly acrylamidoglycolic acid (AGA), methacrylamidoglycolate (MAGME), N-methylolacrylamide (NMA), N-methylolmethacrylamide (NMMA), N-methylolallyl carbamate, alkyl ethers such as the isobutoxy ether or esters of N-methylolacrylamide, of N-methylolmethacrylamide and of N-methylolallyl carbamate; or copolymers with vinyl acetate, 1 to 50 wt % of ethylene and 1 to 50 wt % of a vinyl ester of α-branched monocarboxylic acids having 9 to 13 carbon atoms; wherein the recitations in wt % add up to 100 wt % in each case.

The monomer selection and/or the selection of the weight fractions of the comonomers is made so as to obtain in general a glass transition temperature Tg of ≤+120° C., preferably −50° C. to +60° C., more preferably −30° C. to +40° C. and most preferably −15° C. to +20° C. The glass transition temperature Tg of the polymers is quantifiable in a known manner using differential scanning calorimetry (DSC). The Tg can also be approximately predicted using the Fox equation. After Fox T. G., Bull. Am. Physics Soc. 1, 3, page 123 (1956): $1/Tg=x1/Tg1+x2/Tg2+ \ldots +xn/Tgn$, where xn is the mass fraction (wt %/100) of the monomer n and Tgn is the glass transition temperature in kelvins of the homopolymer of the monomer n. Tg values of homopolymers are reported in Polymer Handbook 2nd Edition, J. Wiley & Sons, New York (1975).

The polymers in the form of aqueous dispersions generally have a solids content of 35 to 65 wt %, preferably 40 to 60 wt % and more preferably 45 to 55 wt %.

The Brookfield viscosity of the aqueous polymer dispersions is preferably from 50 to 1000 mPas, more preferably from 100 to 500 mPas (as determined with a Brookfield viscometer at 23° C., 20 rpm and a solids content of 50 wt % for the dispersions). Such viscosities are particularly advantageous for the spray application of the dispersions.

The polymers are generally obtainable via free-radically initiated polymerization. The preparation of the polymers may be effected in a manner known per se, for example by the suspension polymerization process or preferably by the emulsion polymerization process in the presence of protective colloids or preferably emulsifiers, as described in U.S. Pat. No. 9,938,647.

The polymers are preferably present in the form of emulsifier-stabilized aqueous dispersions. The above described wetting agents might be applied as emulsifiers.

Preferred aqueous polymer dispersions do not contain protective colloids. Examples of protective colloids are polyvinyl alcohols; polyvinylpyrrolidones; polyvinyl acetals; polysaccharides; synthetic polymers such as poly (meth)acrylic acid, copolymers of (meth)acrylates with carboxyl-functional comonomer units, poly(meth)acrylamide, polyvinylsulfonic acids and water-soluble copolymers thereof; styrene-maleic acid and vinyl ether-maleic acid copolymers.

The aqueous binder formulations contain preferably ≥70.0 wt %, more preferably 80 to 99.8 wt %, even more preferably 90 to 99.4 wt % and most preferably 97 to 99 wt % polymers (solid), based on the dry weight of the aqueous binder formulation.

The aqueous binder formulations contain preferably 0.1 to 5.0 wt %, more preferably 0.3 to 3 wt % and most preferably 0.5 to 1.5 wt % of wetting agents, based on the dry weight of the aqueous binder formulation. Examples for wetting agents and preferred wetting agents are described above.

The aqueous binder formulations may contain one or more catalysts, preferably acids, such as organic acids or preferably inorganic acids. The catalysts have a pka of preferably 1 to 6, more preferably 2 to 5 and most preferably 2 to 4.

Preferred organic acids are carboxylic acids, such as citric acid or acetic acid. Examples of inorganic acids are ammonium halogenides, particularly ammonium chloride, or phosphates, particularly mono ammonium phosphate, bisulfate, particularly sodium bisulfate.

The aqueous binder formulations contain preferably 0.1 to 5.0 wt %, more preferably 0.3 to 3 wt % and most preferably 0.5 to 1.5 wt % of catalysts, based on the dry weight of the aqueous binder formulation.

The aqueous binder formulations may contain one or more additives, for instance the additives described above for the aqueous silicone formulation. The aqueous binder formulations contain preferably up to 10.0 wt %, more preferably 0.1 to 5.0 wt % and most preferably 0.5 to 4.0 wt % of additives, based on the dry weight of the aqueous binder formulation.

The aqueous binder formulation contain water and optionally one or more solvents, such as alcohols, ethers or esters. Preferably, the aqueous binder formulations contain more the 90 vol. % and more preferably more than 95 wt % of water, based on the total volume of water and solvents. Most preferably, the aqueous binder formulations do not contain solvents.

The aqueous binder formulations may have a solids content of preferably 1 to 65 wt %, more preferably 5 to 40 wt % and most preferably 10 to 30 wt %.

The aqueous binder formulations may be obtained by mixing their individual constituents, preferably at room temperature with common stirrers. The polymers are preferably applied in the form of aqueous dispersions.

The fibers may be based on natural or synthetic, organic or inorganic fiber materials. Examples for synthetic fiber materials are polyester, polyamide, polypropylene, polyethylene, viscose. Examples for inorganic fiber materials are glass, ceramic, carbon. Examples for natural fiber materials are cellulose, cotton, wool and wood fibers. Organic fiber materials, particularly natural fiber materials are preferred. Most preference is given to cellulose fibers, such as pulp fibers.

The synthetic fibers may be mono-, bi- or multicomponent fibers. Bi- or multicomponent fibers are fibers that have been formed from two or respectively more thermoplastic polymers and that may be extruded from separate extruders, but spun together, to form one fiber. Bi- or multicomponent fibers may have a side-by-side arrangement, a sheath/core arrangement (e.g., eccentric and concentric), a pie wedge arrangement, a hollow pie wedge arrangement, island-in-the-sea, three island or bull's eye arrangements. In a sheath/core bicomponent fiber, for instance, a first polymer component is surrounded by a second polymer component. Preferred bi- or multicomponent fibers are sheath/core fibers, for instance made up of polyethylene/polypropylene or polyolefin/polyester, such as polyethylene/polyester. Such fibers provide fiber webs with improved binding properties.

It is also preferred to apply a mixture of two or more fibers. Preferred fiber mixtures comprise preferably 70 to 97 wt % of natural fibers, particularly cellulose fibers, and preferably 3 to 30 wt % of synthetic fiber materials, preferably polyester, polypropylene or polyethylene, which may be in the form of bi- or multicomponent fibers. Such a combination of fibers is advantageous to handle and provide fiber webs with improved binding properties.

The fibers have a length of preferably 0.5 μm to 20 mm, more preferably 1 to 18 and most preferably 2 to 12. The fibers have an average length of preferably 1 mm to 10 mm. The fibers are generally in the form of loose fibers.

The airlaid nonwovens may be prepared from the fibers in customary fashion by laying down fibers and subsequent consolidation.

The laying down fibers can be carried out with conventional airlay device. Such airlay device usually incorporates a plurality of successive forming heads for blowing the fiber with air. The number of forming heads depends on the desired basic weight for the fiber web and process variants. Fibers are usually blown with air onto a wire, followed by aspirating the air. Alternatively, the fibers may be sifted through a coarse screen and deposited with vacuum assistance onto the forming wire. Optionally, additives might be applied at this stage. Examples of additives are mentioned above.

Subsequently, the laid down fibers can be consolidated by common means, such as latex chemical bonding, thermal bonding, meltblowing, pressure bonding, spunlacing or spun bonding or a combination of such methods. The thermal bonding may be carried out at temperatures of 80° C. to 260° C., the pressure bonding at up to 100 bar, for instance. Alternatively, prefabricated airlaid nonwovens maybe applied in the instant process.

The airlaid nonwoven has generally the form of sheet like fibrous structure.

The basic weight of the airlaid nonwoven is preferably 10 to 1000 g/m$^2$, more preferably 20 to 500 g/m$^2$ and most preferably 30 to 250 g/m$^2$.

An essential step of the instant process is the separate application of the aqueous binder formulation and the aqueous silicone formulation onto the airlaid nonwovens.

Aqueous binder formulations and aqueous silicone formulations are hereinafter jointly referred to as instant aqueous formulations.

It is possible to spray first one or more aqueous binder formulations onto the surface of an airlaid nonwoven and subsequently one or more aqueous silicone formulations. Alternatively, it is also possible to spray one or more aqueous binder formulations and one or more aqueous silicone formulations in the reverse order. In an alternative embodiment, it is also possible to spray one or more mixtures of aqueous binder formulations and aqueous silicone formulations onto the surface of an airlaid nonwoven and optionally separately one or more aqueous binder formulations, provided that additionally one or more aqueous silicone formulations are sprayed in one or more separate steps onto the surface of an airlaid nonwoven. Preferably, one or more aqueous silicone formulations are sprayed as topical spray application onto the surface of the airlaid nonwovens.

The aqueous binder formulations and/or the aqueous silicone formulations may be applied onto solely one side and preferably onto both sides of the airlaid nonwovens.

The application of the instant binder and silicone formulations onto the airlaid nonwovens can generally be carried by spray application. By this, the respective dispersions may be atomized into droplets. Common spraying device is appropriate for that purpose. Typical spraying device includes means for delivering the aqueous formulations to spray nozzles and then atomizing the aqueous formulations through orifices of the nozzles. For instance, vessels containing the aqueous formulations are pressurized, for example with nitrogen or air, pushing the aqueous formulations out of the vessel, preferably through flow meters, and then to the nozzles. Alternatively, the aqueous formulations to be sprayed can also be pumped to spray nozzles. The nozzles typically have small exit orifice diameters which act to atomize the aqueous formulations at high pressures. This effects improved surface area coverage onto the surface of the nonwoven. Preferably, a vacuum under the nonwoven at the point of spray application helps pull the aqueous formulations into the nonwoven. This effects good uniform coverage through the substrate. Examples of appropriate spray nozzles are Unijet or Veejet, particularly the spray tip Unijet 8001E (tradenames of Spray Systems).

The airlaid nonwovens sprayed with aqueous binder formulations and/or aqueous silicone formulations may be dried or cured before a further of the instant aqueous formulations is applied. But drying or curing is not required before a further of the instant aqueous formulations is applied.

The drying or curing is performed at temperatures of preferably 130° C. to 180° C., preferably 140° C. to170° C. and most preferably 145° C. to 155° C. Drying may be accomplished preferably at atmospheric pressure. By this, the linting of the fiber webs can be reduced.

Preferably silicone formulations are first sprayed on one side of the airlaid nonwoven, then binder formulations are sprayed on the same side of the airlaid nonwoven followed by a drying step, and then the other side of the airlaid non-woven is treated in the same way.

The spraying of one or more aqueous binder formulations onto the surface of an airlaid nonwoven results in an add-on of polymers (solid) of preferably 1 to 40 wt %, more preferably 8 to 30 wt % and most preferably 10 to 25 wt %, based on the dry weight of the fiber webs.

The spraying of one or more aqueous silicone formulations onto the surface of an airlaid nonwoven results in an add-on of polysiloxanes (solid) of preferably 0.1 to 5.0 wt %, more preferably 0.2 to 3 wt % and most preferably 0.5 to 2 wt %, based on the dry weight of the fiber webs.

The instant fiber webs contain for instance 0.5 to 40 wt %, preferably 1.0 to 25 wt %, more preferably 8 to 20 wt % of polymers in case that the airlaid nonwovens are prepared with latex chemical bonding. The instant fiber webs contain for instance 0.5 to 10 wt %, preferably 1 to 8 wt % of polymers in case that the airlaid nonwovens are prepared with thermal bonding, meltblowing, pressure bonding, spunlacing or spun bonding or not with latex chemical bonding. The figures in wt % refer in each case to the dry weight of the fiber webs.

The fiber webs of the instant invention may be used for instance in the automotive construction or in the building construction sector, for example as insulants, or for use in the hygiene sector, for example for manufacturing diapers or sanitary napkins, hygiene products, like household articles, or filter media. Preferably, the fiber webs are used as non-woven clean room wipes, preferably in lines for production of electronic circuit boards, or medical application, such as medical draping.

Surprisingly, the instant application of polysiloxanes and polymers to the airlaid nonwoven surface greatly reduces lose fibers, particularly short fiber lint, in the nonwoven and provides fiber webs for applications which require very low linting levels. The instant fiber webs show preferably a level of linting short fibers which is reduced by as much as 99% compared to conventional fiber webs. Against this, the mere application of blends of polysiloxanes and polymers did not achieve lint reduction. It was found, that polysiloxanes and polymers need to be applied separately.

The water absorbency of the fiber webs can be boosted by the addition of wetting surfactants without loss of the fiber lint reduction affect. By this, the absorbency can be increased by at least 75%, for instance.

Finally, the fiber webs show the desired mechanical properties, such as strength, particularly wet tensile strength or dry tensile strength.

The examples which follow serve for detailed elucidation of the invention and should in no way be understood to constitute any restriction.

Starting Materials and Formulations:

Untreated Airlaid Substrate:

Based on 88 wt % cellulose and 12 wt % bicomponent fiber consisting of a polyethylene sheath and polyester core; basis weight: 90 g/m$^2$;

The untreated airlaid substrate contained no chemical binder and was bonded by thermal treatment.

Aqueous Copolymer Dispersion:

Aqueous dispersion of a surfactant stabilized copolymer based on vinyl acetate, ethylene, N-methylolacrylamide and acrylamide having a solids content of 52%, a glass transition temperature Tg of +10° C., a viscosity 250 mPas (determined with a Brookfield-viscosimeter at 23° C., 20 rpm) and a pH of 5.0.

Aqueous Binder Formulation:

The aqueous binder formulation had a solid level of 20%. The above aqueous copolymer dispersion made up 98.0 wt % of the solids of the aqueous binder formulation, Aerosol OT (tradename of Solvay, sodium dioctyl sulfosuccinate) made up 1.0 wt % and ammonium chloride ($NH_4Cl$; acid catalyst) made up 1 wt %. The figures in wt % refer to dry/dry.

Aqueous Silicone Formulation:

The following aqueous emulsions of polysiloxanes were applied:

- Wacker E335 (tradename of Wacker Chemie): polydimethylsiloxane (solid content: 34-44%);
- Finish CT 78 E (tradename of Wacker Chemie): aminofunctional polylsiloxane (solid content: 40%);
- HC 3502 (tradename of Wacker Chemie): polydimethylsiloxane having aminoalkyl groups (solid content: 20%);
- Powersoft CF 20 (tradename of Wacker Chemie): aminofunctional polysiloxane (solid content: 20%);
- Pulpsil 943S (tradename of Wacker Chemie): polysiloxane with polyether groups (solid content:100%).

Spray Application:

The aqueous silicone formulation specified for each Example and the aqueous binder formulation were sprayed according to one or more of the following methods 1 to 4 onto the untreated airlaid substrate with the use of an automated hand sheet sprayer and Unijet 8001E (tradename of Spray Systems) as spray tip. The spray pressure was 80 psi. The spray arm speed was set to achieve an aqueous binder formulation add-on of 20 wt % and 1 wt % silicone add-on per spray step except specified otherwise (each dry on dry substrate).

After spraying, drying was accomplished at 150° C. for 3 minutes in a Mathis drying oven.

Alternative Methods for Spray Applications:

1. Method:

Using a Blend of Polymer and Silicone:

The blend had a solid content of 20% and based on the following ingredients: 95.4 wt % of the above aqueous copolymer dispersion, 1.0 wt % of Aerosol OT, 1 wt % of ammonium chloride (acid catalyst); 2.6 wt % of aqueous silicone formulation (specified for each Example). The figures in wt % refer to dry/dry.

The blend was sprayed on both sides of the untreated airlaid substrate to achieve an add-on level of 20% (dry/dry).

Drying was done sequentially after each side was sprayed.

2. Method:

Spraying of Aqueous Silicone Formulations Onto Dried Chemically Bonded Airlaid Substrates:

The untreated airlaid substrate was first sprayed with the aqueous binder formulation onto both surfaces successively and afterwards with the respective aqueous silicone formulation (1% emulsions) onto both surfaces successively.

Drying was done after each spraying step.

3. Method:

Spraying of Aqueous Silicone Formulations Onto "Undried" Chemically Bonded Airlaid Substrates:

One side of the untreated airlaid substrate was first sprayed with the aqueous binder formulation, followed by spraying with the respective aqueous silicone formulation (1% emulsion) and drying.

Afterwards, the other side of the airlaid substrate was sprayed and dried in the same manner.

4. Method:

Double Dosage of Silicone:

Method 1 was followed by Method 2.

The total silicone add-on was 1 wt % (dry silicone/dry substrate).

Lint Testing Procedure

The linting was tested according to the Standard Procedure of Nonwoven Standard Procedures NWSP 160.1.RO (15) (Resistance to Linting of Nonwoven Fabrics (Dry)).

Determination of the Absorbency:

A 5 cm disc sample of the respective airlaid substrate was cut on a carver press. The water absorbency of the sample was determined using a Sherwood ATS—600 Testing System.

EXAMPLE 1

The Samples 1~4 were prepare as follows:

Sample 1 (Comparative (C)):

The untreated airlaid substrate was sprayed with the aqueous binder formulation onto both surfaces successively. Drying was done after each spraying step.

No silicone formulation was applied.

Sample 1 corresponds to Method 2 except that no aqueous silicone formulation was sprayed.

Sample 2 (Inventive (I)):

The airlaid substrate from the above Sample 1 was sprayed with the aqueous silicone formulation Finish CT 78 E silicone (1% solids content; 1% add-on dry on dry substrate). This corresponds to Method 2.

Sample 3 (Inventive (I)):

The untreated airlaid substrate was sprayed according to the Method 4 using as aqueous silicone formulation Powersoft CF20 (1% solids emulsion) for the first step and Powersoft CF20 (1% solids emulsion) for the second step.

Sample 4 (Inventive (I)):

The untreated airlaid substrate was sprayed according to the Method 4 using as aqueous silicone formulation Finish CT 78 E (1% solids emulsion) for the first step as well as for the second step.

The linting of the Samples 1 to 4 was tested according to the above Lint Testing Procedure. The test results are shown in Table 1.

TABLE 1 linting of the Samples 1 to 4 from Example 1:

| | | | Lint Values | |
|---|---|---|---|---|
| Sample | Method | Silicone over spray | lint fibers > 0.5 μm | lint fibers > 2.0 μm |
| 1 (C) | Method 2, but no silicone | — | 21,833 | 6,707 |
| 2 (I) | Method 2 | Finish CT78E | 769 | 404 |
| 3 (I) | Method 4 | Powersoft CF20 | 576 | 285 |
| 4 (I) | Method 4 | Finish CT78E | 624 | 309 |

The inventive Samples 2~3 having silicone over sprayed showed significantly reduced fiber linting compared to the non-inventive Sample 1.

EXAMPLE 2

Sample 1 (Comparative 8c)):

The untreated airlaid substrate was sprayed with the above described aqueous binder formulation onto both surfaces successively. Drying was done after each spraying step.

No silicone formulation was applied.

Sample 1 corresponds to Method 2 except that no aqueous silicone formulation was sprayed.

Sample 2 (Comparative (C)):

Both sides of the airlaid substrate from the above Sample 1 were sprayed with water.

No silicone formulation was applied.

Sample 2 is related to Method 2 except that water was sprayed instead of the aqueous silicone formulation.

Sample 3 (Comparative (C)):

The above described aqueous copolymer dispersion was diluted to 1% solids and sprayed successively onto both sides of the untreated airlaid substrate from the above Sample 1. Drying was done after each spraying step. No silicone formulation was applied.

Sample 2 is related to Method 2 except that a diluted aqueous copolymer dispersion was sprayed instead of the aqueous silicone formulation.

Sample 4 (Comparative (C)):

The untreated airlaid substrate was sprayed according to Method 1 with a blend using Wacker E335 (1% solids emulsion).

Sample 5 (Inventive (I)):

Both sides of the dried airlaid substrate from the above Sample 1 were sprayed with the silicone Wacker E335 (1% solids emulsion) successively with drying after each spraying step.

This corresponds to Method 2.

Sample 6 (Inventive (I)):

Both sides of the dried airlaid substrate from the above Sample 4 were sprayed with Wacker E335 (1% solids emulsion) successively with drying after each spraying step.

This corresponds to Method 4.

Sample 7 (Comparative (C)):

The untreated airlaid substrate was sprayed according to Method 1 with a blend using HC3025 (1% solids emulsion).

Sample 8 (Inventive (I)):

Both sides of the dried airlaid substrate from the above Sample 1 were sprayed with Finish CT 78 E (1% solids emulsion) successively with drying after each spraying step.

This corresponds to Method 2.

The linting of the Samples 1 to 4 from Example 2 was tested according to the above Lint Testing Procedure. The test results are shown in Table 2.

TABLE 2 linting of the Samples 1 to 8 from Example 2:

| | | | Lint Values | |
|---|---|---|---|---|
| Sample | Method | Overspray | lint fibers > 0.5 μm | lint fibers > 2.0 μm |
| 1 (C) | Method 2, but no silicone | — | 46,111 | 13,362 |
| 2 (C) | Method 2, but no silicone | water | 34,683 | 9,346 |
| 3 (C) | Method 2, but no silicone | copolymer | 22,870 | 5,972 |
| 4 (C) | Method 1 | — | 20,552 | 6,618 |
| 5 (I) | Method 2 | Wacker 335 | | |
| 6 (I) | Method 4 | Wacker 335 | 940 | 565 |
| 7 (C) | Method 1 | — | 11,725 | 4,551 |
| 8 (I) | Method 2 | Wacker CT78 | 1178 | 622 |

Comparative Samples 1 to 3 show that the overspray of water or the copolymer binder was not effective for reducing the lint in contrast to the inventive approach with Inventive Samples 5 and 8.

The combined spraying of silicone and copolymer binder, but without silicone overspray does not reduce the lint compared to the instant approach with silicone overspray (see Comparative Sample 4 and Inventive Sample 6).

The results demonstrate that silicone as an overspray by itself is very effective in reducing the fiber lint in a chemically bonded airlaid thus requiring a two-step process. Formulating the silicone into the binder is not required.

EXAMPLE 3

Comparative

In Example 3, no binder formulation was sprayed onto the airlaid substrate.

Sample 1 (Comparative):

The above described untreated airlaid substrate.

Thus, no silicone formulation and no binder formulation were applied.

Sample 2 (Comparative):

The untreated airlaid substrate (=above Sample 1) was sprayed with the above described silicone Wacker E335 (1% solids emulsion) onto both surfaces successively. Drying was done after each spraying step.

No binder formulation was applied.

Sample 3 (Comparative):

The untreated airlaid substrate (=above Sample 1) was sprayed with a glycerin solution (1% in water) onto both surfaces successively. Drying was done after each spraying step.

Thus, no silicone formulation and no binder formulation were applied.

The linting of the Samples 1 to 3 from Example 3 was tested according to the above Lint Testing Procedure.

Unfortunately, all three Samples produced such an extraordinary quantity of fiber lint, that the laser particle counter was overwhelmed and could not provide a count.

Based on these results it is apparent that the airlaid substrate requires both a chemical binder as well as the silicone over spray to reduce the lint fiber.

EXAMPLE 4

The effect of the sequence of copolymer binder and silicone addition was examined.

Sample 1 (Comparative (C)):

The untreated airlaid substrate was sprayed with the above described aqueous binder formulation onto both surfaces successively. Drying was done after each spraying step.

No silicone formulation was applied.

Sample 1 corresponds to Method 2 except that no aqueous silicone formulation was sprayed.

Sample 2 (Inventive (I)):

The untreated airlaid substrate was sprayed according to the Method 3 using Wacker E335 (1% solids emulsion) as aqueous silicone formulation;

e.g. the aqueous binder formulation was sprayed before the aqueous silicone formulation.

Sample 3 (Inventive (I)):

One side of the untreated airlaid substrate was first sprayed with the silicone Wacker E335 (1% emulsion), followed by spraying the above described aqueous binder formulation.

Afterwards, the other side of the airlaid substrate was sprayed and dried in the same way;

e.g. the aqueous binder formulation was sprayed after the aqueous silicone formulation.

The linting of the Samples 1 to 3 from Example 4 was tested according to the above Lint Testing Procedure. The test results are shown in Table 3.

The results of Example 4 show that the order of spray addition does not matter.

TABLE 3 linting of the Samples 1 to 3 from Example 4:

| Sample | first spray | second spray | Lint Values: lint fibers > 0.5 μm | Lint Values: lint fibers > 2.0 μm |
|---|---|---|---|---|
| 1 (C) | binder formulation | — | 24,384 | 8,537 |
| 2 (I) | binder formulation | silicone formulation | 484 | 295 |
| 3 (I) | silicone formulation | binder formulation | 504 | 301 |

EXAMPLE 5

The water absorbency rate of the airlaid substrate was tested.

Sample 1 (Comparative (C)):

The untreated airlaid substrate was sprayed with the above described aqueous binder formulation onto both surfaces successively. Drying was done after each spraying step.

No silicone formulation was applied.

Sample 1 corresponds to Method 3 except that no aqueous silicone formulation was sprayed.

Sample 2 (Inventive (I)):

The untreated airlaid substrate was sprayed according to the Method 3 using Wacker E335 (1% solids emulsion) as aqueous silicone formulation;

e.g. the untreated airlaid substrate was first sprayed with the aqueous binder formulation and afterwards with the aqueous silicone formulation.

Sample 3 (Inventive (I)):

Sample 2 was repeated, except that Wacker E335 (1% solids emulsion) was replaced by an aqueous silicone formulation comprising Wacker E335 (1 wt %) and Aerosol OT (1 wt %).

The figures in wt % refer to the dry weight of the aqueous silicone formulation.

The water absorbency as well as the linting of the Samples 1 to 3 from Example 5 was determined as described above. The test results are shown in Table 4.

TABLE 4 linting of the Samples 1 to 3 from Example 5:

| Sample | Method | Overspray | lint values: lint fibers > 0.5 μm | lint values: lint fibers > 2.0 μm | absorbency Rate [g/g/sec] |
|---|---|---|---|---|---|
| 1 (C) | Method 3, but no silicone | — | 20,175 | 7,748 | 1.02 |
| 2 (1) | Method 3 | Wacker E335 | 919 | 492 | 0.23 |
| 3 (1) | Method 3 | Wacker E335, Aerosol OT | 1,158 | 696 | 0.75 |

Example 5 demonstrates, that the overspray of a wetting agent improves the water absorbency while maintaining reduced fiber lint.

What is claimed is:

1. A process for producing fiber webs, comprising:

a) spraying one or more aqueous latex binder formulations containing at least one vinyl ester polymer, (meth) acrylic ester polymer, or mixture thereof onto a surface of an airlaid nonwoven, and, b) in a step separate from step a), spraying one or more aqueous silicone formulations containing one or more polysiloxanes onto the surface of the airlaid nonwoven, wherein the fibers of the airlaid nonwoven have a length of 0.5 μm to 20 mm and an average length of from 1 mm to 10 mm and the fiber webs comprise natural fiber materials selected from the group consisting of cellulose fibers, wherein the vinyl ester polymers are selected from the group consisting of a) copolymers of one or more vinyl esters with 1 to 50 wt % of ethylene;

b) copolymers of one or more vinyl esters with 1 to 50 wt % of ethylene and with 0.5 to 10.0 wt % of post-crosslinking monomers;

c) copolymers of vinyl acetate with 1 to 50 wt % of ethylene, with 1 to 50 wt % of one or more vinyl esters having 1 to 13 carbon atoms in the carboxylic acid moiety and optionally 0.5 to 10.0 wt % of post-crosslinking monomers;

d) copolymers of one or more vinyl esters, 1 to 50 wt % of ethylene, 1 to 60 wt % of one or more (meth)acrylic esters of branched or unbranched alcohols having 1 to 15 carbon atoms, and optionally 0.5 to 10.0 wt % of post-crosslinking monomers;

e) copolymers of 30 to 75 wt % of vinyl acetate, 1 to 30 wt % of one or more vinyl ester monomers selected from the group consisting of vinyl laurate and vinyl esters of alpha-branched carboxylic acids having 9 to 13 carbon atoms, and mixtures thereof, and 1 to 30 wt % of one or more (meth)acrylic esters of branched or unbranched alcohols having 1 to 17 carbon atoms, 1 to 40 wt % of ethylene, and optionally 0.5 to 10.0 wt % of post-crosslinking monomers; and f) copolymers of one or more vinyl esters, 1 to 50 wt % of ethylene, 1 to 60 wt % of vinyl chloride, optionally (meth)acrylic esters and optionally 0.5 to 10.0 wt % of post-crosslinking monomers, wherein the recitations in wt % of monomers in each copolymer a) through f) add up to 100 wt %, and wherein the one or more polysiloxanes comprise units of the formula $$R_cSi(OR')_d(OH)_eO_{(4-c-d-e)/2}$$

with c=0 to 3, d=0 to 3, e=0 to 3, and with the sum c+d+e being per unit not more than 3.5, in which in each case R is identical or different and denotes branched or unbranched alkyl radicals having 1 to 22 C atoms, cycloalkyl radicals having 3 to 10 C atoms, alkylene radicals having 2 to 4 C atoms, and also aryl, aralkyl, and alkylaryl radicals having 6 to 18 C atoms, and R' denotes identical or different alkyl radicals and alkoxyalkylene radicals having in each case 1 to 4 C atoms, where the radicals R and R' are optionally substituted by halogens, ether, thioether, ester, amide, nitrile, hydroxyl, amine, carboxyl, sulfonic acid, carboxylic anhydride, and/or carbonyl groups.

2. The process of claim 1, wherein the vinyl ester polymers and the (meth)acrylic ester polymers contain one or more crosslinking monomer units, wherein the crosslinking monomers units are selected from the group consisting of acrylamidoglycolic acid; methacrylamidoglycolate; N-methylolacrylamide; N-methylolmeth-acrylamide; N-methylolallyl carbamate; alkyl ethers or esters of N-methylolacrylamide; alkyl ethers or esters of N-methylolmethacrylamide; alkyl ethers or esters of N-methylolallyl carbamate; glycidyl methacrylate; glycidyl acrylate; acryloyloxypropyltri(alkoxy) silanes, glycidyl methacryloyloxypropyl-tri(alkoxy)silanes, vinyltrialkoxysilanes and vinylmethyldialkoxysilanes where the alkoxy groups are individually selected from the group consisting of methoxy, ethoxy and ethoxy propylene glycol ether radicals.

3. The process of claim 1, wherein the one or more polysiloxanes are dimethylpolysiloxanes.

4. The process of claim 1, wherein one or more polysiloxanes are dimethylpolysiloxanes optionally having Si—OH groups in the terminal units and optionally being functionalized by amino groups, aminoalkyl groups and/or polyether groups.

5. The process of claim 1, wherein one or more aqueous silicone formulations and/or one or more aqueous binder formulations contain one or more wetting agents selected from the group consisting of alkyl sulfates having a chain length of 8 to 18 carbon atoms; alkyl or alkylaryl ether sulfates having 8 to 18 carbon atoms in the alkyl or alkylaryl moiety and up to 40 ethylene or propylene oxide units; alkyl or alkylaryl sulfonates having 8 to 18 carbon atoms; oleic acid sulfonates; esters and/or monoesters of sulfosuccinic acid with monohydric alcohols or alkylphenols; alkyl polyglycol ethers or alkylaryl polyglycol ethers having 8 to 40 ethylene oxide units; and polymers of ethylene oxide, propylene oxide or ethylene oxide/propylene oxide copolymers.

6. The process of claim 5, wherein one or more aqueous silicone formulations and/or one or more aqueous binder formulations contain 0.1 to 5.0 wt % of wetting agents, based on the dry weight of the aqueous binder formulations or the aqueous silicone formulations.

7. The process of claim 1, wherein the (meth)acrylic acid ester polymer is a polymer prepared from monomers selected from the group consisting of methyl acrylate, methyl methacrylate, ethyl acrylate, ethyl methacrylate, propyl acrylate, propyl methacrylate, n-butyl acrylate, n-butyl methacrylate, 2-ethylhexyl acrylate, norbornyl acrylate, and mixtures thereof.

8. The process as of claim 1, wherein the fibers of the airlaid nonwoven have a length of 0.5 μm to 12 mm.

9. The process of claim 1, wherein the airlaid nonwoven has a basis weight of 10 to 1000 g/m$^2$.

10. The process of claim 1, wherein first one or more aqueous binder formulations are sprayed onto the surface of the airlaid nonwoven and subsequently one or more aqueous silicone formulations are sprayed thereon; or first one or more aqueous silicone formulations are sprayed onto the surface of the airlaid nonwoven and subsequently one or more aqueous binder formulations are sprayed thereon; or one or more mixtures of aqueous binder formulations and aqueous silicone formulations are sprayed onto the surface of the airlaid nonwoven, optionally followed by spraying thereon one or more aqueous binder formulations, provided that additionally one or more aqueous silicone formulations are sprayed thereon in one or more separate steps.

11. The process of claim 1, wherein the spraying of one or more aqueous binder formulations onto the surface of the airlaid nonwoven results in an add-on of polymers, calculated as solids, of 1 to 40 wt % and/or the spraying of one or more aqueous silicone formulations onto the surface of the airlaid nonwoven results in an add-on of polysiloxanes calculated as solids, of 0.1 to 5.0 wt %, each based on the dry weight of the fiber webs.

12. The process of claim 1, wherein the fiber web produced is a non-woven clean room wipe, a fiber web for a sanitary napkin or diaper, a filter medium, or an insulant.

13. The process of claim 1, wherein the fiber webs contain from 8 to 20 weight percent of latex binder and silicone formulation when the fibers of the fiber web are bound using only an aqueous latex binder and a silicone formulation.

14. The process of claim 1, wherein the fiber webs contain from 0.5 to 10 weight percent of latex binder and silicone formulation when meltable thermoplastic and/or bicomponent fibers are additionally employed for bonding fibers of the fiber web.

15. The process of claim 1, wherein the fiber webs contain from 1 to 8 weight percent of latex binder and silicone formulation when meltable thermoplastic and/or bicomponent fibers are additionally employed for bonding fibers of the fiber web.

16. The process of claim 1, wherein at the airlaid nonwoven is first sprayed with an aqueous silicone formulation, and then with an aqueous binder formulation.

* * * * *